United States Patent [19]

Larsson

[11] 3,949,509

[45] *Apr. 13, 1976

[54] FIRING MECHANISM WITH ADJUSTABLE TRIGGER-SEAR OVERLAP AND SAFETY MECHANISM

[75] Inventor: Sven Gunnar Olof Larsson, Huskvarna, Sweden

[73] Assignee: Forenade Fabriksverken, Eskilstuna, Sweden

[ * ] Notice: The portion of the term of this patent subsequent to Sept. 13, 1991, has been disclaimed.

[22] Filed: Aug. 29, 1968

[21] Appl. No.: 756,159

[30] Foreign Application Priority Data

Sept. 1, 1967 Sweden ..... 12147/67

[52] U.S. Cl. ..... 42/70 R

[51] Int. Cl. ..... F41c 17/00

[58] Field of Search ..... 42/70.4, 70.3, 70, 69 A, 42/16, 16.1, 16.5

[56] References Cited

UNITED STATES PATENTS

| | | | |
|---|---|---|---|
| 1,446,763 | 2/1923 | Nelson | 42/70 |
| 2,191,521 | 2/1940 | Crockett | 42/70 |
| 2,869,269 | 1/1959 | Couture | 42/70 |
| 3,370,374 | 2/1968 | Larsson | 42/69 A |

*Primary Examiner*—Samuel Feinberg
*Assistant Examiner*—C. T. Jordan
*Attorney, Agent, or Firm*—Eric Y. Munson

[57] ABSTRACT

A rifle with a cylinder lock comprising a receiver, a breech bolt with a firing member, a trigger, and a spring actuated sear which in an operating position is in locking engagement between a shoulder on it and another shoulder on the trigger, the sear being depressed at firing by the firing member into an inoperative position, a safety mechanism having an "on" and an "off" position and cooperating with a ledge on the sear to lock the sear in either the operative position or in the inoperative position depending on the condition, that is locked or released, of the trigger.

1 Claim, 7 Drawing Figures

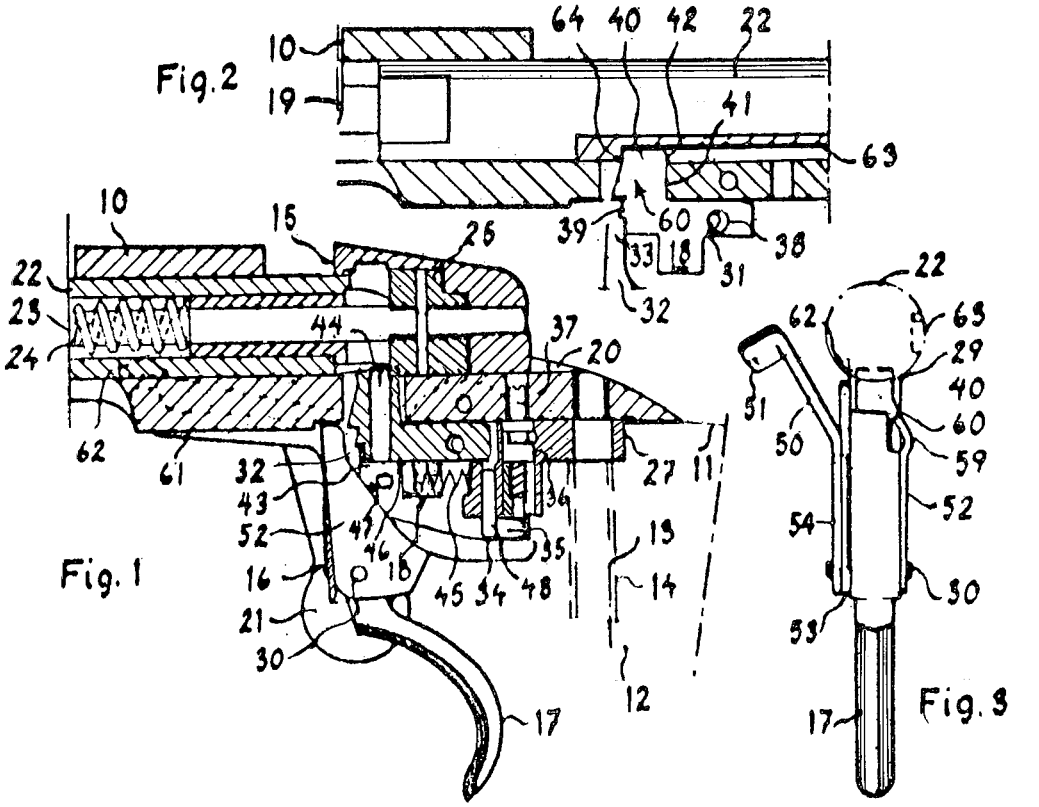
Fig. 2
Fig. 1
Fig. 3
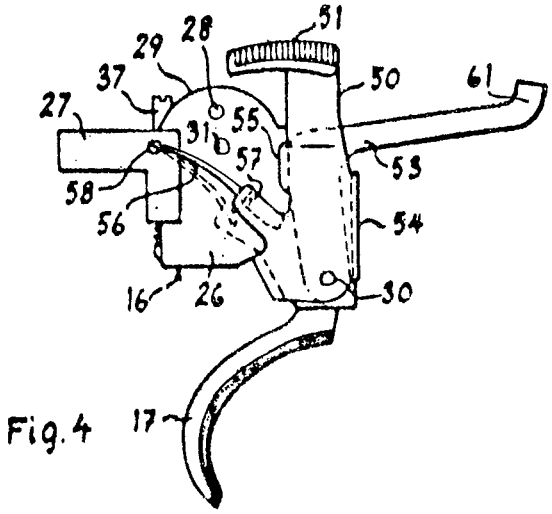
Fig. 4
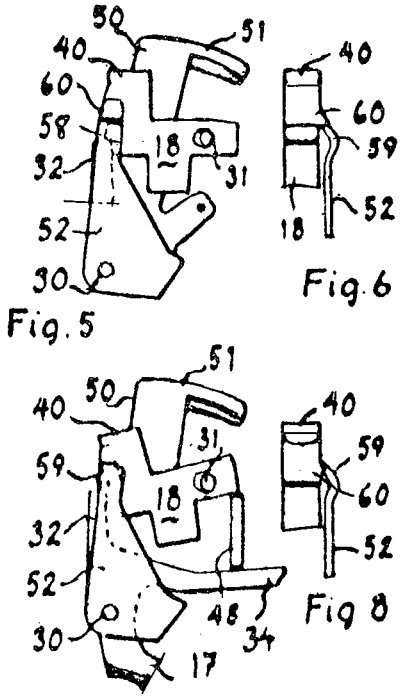
Fig. 5
Fig. 6
Fig. 7
Fig 8

FIRING MECHANISM WITH ADJUSTABLE TRIGGER-SEAR OVERLAP AND SAFETY MECHANISM

BACKGROUND OF THE INVENTION

This invention relates to a rifle, especially rifles used for hunting and sport purposes, of the type provided with a cylinder lock comprising a receiver and therein a rectilinearly movable and retractable breech bolt having a firing member actuated by a firing spring and a trigger mechanism embodying a trigger and a spring actuated sear having a shoulder which in the cocked position of the sear engages a withdrawable cocking shoulder arranged on the trigger, and a locking lug arranged in the receiver thereby keeping the firing member in a cocked position, said sear being depressed when the rifle is discharged by said firing member under its spring loading into an inoperative position against the action of a spring acting on said sear, the sear shoulder being arranged at the forward end of the sear, and the locking lug passing through an opening in an upwardly open rear portion of the receiver to cooperate with said firing member, and said sear being pivoted at its rear, as well as the rest of the trigger mechanism, in a separate assembly yoke positioned below the receiver, which is generally cylindrical in shape.

SUMMARY OF THE INVENTION

The invention is intended to provide a simple, compact and reliable locking and firing mechanism designed to effectively render the rifle safe in both the cocked and the released condition of its firing member, to use the sear locking lug for the firing member as a bolt catch and to make possible a convenient adjustment of the necessary firing pressure on the trigger. This is achieved above all by making a safety mechanism which is movable between an "on" and an "off" position and which cooperates with a ledge on the sear to lock when in the on position the sear in the operative position or in the inoperative position depending on the condition, that is locked or released, of the trigger mechanism.

BRIEF DESCRIPTION OF THE DRAWINGS

Further and more specific objects and advantages of the invention will be apparent from the following description, taken in connection with the accompanying drawings in which:

FIG. 1 is a vertical longitudinal sectional view of the rear portion of the bolt mechanism of the invention in a cocked and safety mechanism in the off position;

FIG. 2 is a fragmentary longitudinal sectional view illustrating members of the mechanism of the rifle of the invention with the bolt in retracted position;

FIG. 3 is a front view of a separate assembly yoke embodied with the receiver;

FIG. 4 is a side elevational view of the assembly yoke and safety means thereon;

FIGS. 5 and 6 are fragmentary side and front views, respectively, illustrating the sear locked in an operative position; and FIGS. 7 and 8 are views similar to FIGS. 5 and 6 illustrating the sear locked in an inoperative position.

DETAILED DESCRIPTION OF THE PREFERRED EMBODIMENT

The arrangement illustrated in the drawings includes a receiver 10 fastened at the rear end to the gun stock 11 and bottom fittings 12 by means of a screw 13 with a spacer 14 and forwardly thereof by another screw (not shown), a bolt 15 rectilinearly movable in the receiver and retractable backwards, a flat downwardly extending assembly-yoke 16 secured to the bottom of the receiver and supporting a trigger 17, a sear 18 and the safety means. The receiver 10 presents a loading opening 19 and an upwardly open end 20 but is otherwise substantially cylindrical in shape. The bolt 15 includes a front portion 22 provided with a handle 21 turnable in a forward end position and a firing member comprising a firing pin 24 and a nut 25, which are adapted to move solely in the longitudinal direction thereof and which are actuated by a spring 23. The assembly-yoke 16 has two rearwardly bent branches 26 joined by a rear portion 27 clamped between the receiver and the spacer 14. The yoke is otherwise secured to the receiver only by means of a cross pin 28 centrally passing through circular sector lugs 29 on the branches 26, said lugs being fit in corresponding recesses in the receiver.

The trigger 17 and the sear 18 are pivotally mounted between the branches 26 on pins 30 and 31, respectively. The trigger has an upwardly extending arm 32 which presents a locking shoulder 33 and a rearwardly extending arm 34. A spring 35 is tensioned between the arm 34 and an immobile nut 36 mounted on an adjusting screw 37 which is positioned in the assembly-yoke 16 and the receiver portion 20 and which limits the rearward movement of the trigger. The sear presents at the rear thereof a hole 38 having a greater diameter or length than the pivot pin 31 and adapted to receive that pin, and at the front a locking shoulder 39 which is adapted to cooperate with the shoulder 33 on the trigger 17 and with a locking lug 40 having a rear wall 41 and positioned in an opening in the receiver portion 20, said lug which is provided with a locking surface 42 extending vertically when in an operative position and engaging a corresponding surface arranged on the firing pin nut 25. The trigger arm 32 rests in a position retaining the sear on an eccentric 43 mounted on a vertical adjusting bolt 44 journalled in the locking lug 40. The sear spring 45 is mounted between the portion 27 of the assembly-yoke 16 and a plunger 46 which is journalled in the sear and bears against a lower portion 47 of the eccentric 43, said lower portion being constructed to present an angular configuration by providing the same with e.g., recesses or cavities by which arrangement the eccentric is kept in a constant axial position and in the adjusted angular position. The rear end of the sear is adapted to cooperate with a pin 48 which is mounted for sliding movement in the portion 27 of the assembly-yoke, and which is moved upwards by means of the trigger arm 34 when the rifle is discharged.

The safety means includes an arm 50 with a handle 51 to the right of the receiver 10, an U-bent arm 52 which is bent rearwardly from the arm 50 to the left of the assembly-yoke 16 and between the assembly-yoke and the arm 50 an angular arm 53 presenting a clearance between edges 54, 55 bent in from the arm 50, said three arms being pivotally mounted on the pin 30. An elastic slightly curved link 56 arranged between the portion 27 of the assembly-yoke and the arm 50 holds the arms 50, 52 in a rear on position as shown in FIGS. 5–8 or a forward off position as shown in FIGS. 1 and 4, the connection of the link 56 on the arm 50 being then positioned on one side or the other of a line from the pin 30 to the connection 58 at the wall 27, said positions being fixed by limit stops formed by, e.g., the assembly-yoke 16. In the on position of the safety mechanism, the upper bent end 59 of arm 52 is positioned either below or above a ledge 60 on the sear in operative and inoperative position, respectively (see FIGS. 5, 6 and 7, 8, respectively), and the free end 61 of the arm 53 which is movable in a slot in the bottom of the receiver 10 is held by the edge 54 in a lifted operative position in engagement with a recess 62 arranged in the bolt 22. In the off position of the safety mechanism shown in FIG. 1, the end 59 of arm 50 is positioned forward of the ledge 60 and the end 61 of the arm 53 is moved out of engagement with the recess 62 when actuated by the edge 55.

When discharging the rifle the locking shoulder 33 is moved away from the sear 18, which is thus released, and the firing pin nut 25 is thrown forwards by the firing spring 23 simultaneously depressing the locking lug 40, which is held down by the nut in the forward end position thereof. When the trigger is released, its spring 35 moves the arm 32 into contact with the front face of the locking shoulder 39. When the handle 21 is manipulated, e.g., upon reloading, a longitudinal groove 63 is caused to register with the lug 40 after which the bolt can be retracted until the end 64 of the groove strikes the front face of the lug 40 which during the retraction of the bolt is released from the nut 25 and swung up by the spring 45; the locking shoulder 33 of the trigger taking up a position below the shoulder 39 on the sear, FIG. 2. The play allotted to the pin 31 in the hole 38 is such that the shock created by the impact between the end 64 of the groove and the lug 40 is absorbed by the rear wall 41 in the receiver portion 20, thereby protecting the sear and its pivot pin 31. Upon subsequent closing of the bolt the nut 25 is caught by the lug 40 and the shoulders 33, 39 are returned to locking engagement. For the purpose of removing the bolt, a slow firing sequence is carried out subsequent to opening the bolt, so that the pin 48 actuates the sear and moves the lug 40 out of the path of movement of the end 64 of the groove 63.

The upper end 59 of the arm 52 forms a cam which is moved down below the ledge 60 of the sear when the arm is moved from the position shown in FIG. 1 to the position shown in FIG. 5, thereby slightly lifting said ledge and thus releasing the locking shoulder 33 of the trigger. If the structure of the locking surface 42 was such that it inclined upwardly, lifting of the lug 40 and, thus, also the turning of the arms 50, 52 into the position shown in FIG. 5 would have to be effected against the action of the firing spring 23. In order that the rifle may be made safe in the released condition the lug 40 can be lowered by carrying out a long trigger motion and then turning the arm 52 into the on position, as shown in FIGS. 7 and 8 so that the arm end 59 grasps above the ledge 60 and thus prevents the spring 45 from turning the sear into the operative position after the trigger is released. The arm 53 prevents turning of the bolt portion 22 in both safety positions. The play of the arm 53 between the edges 54, 55 reduces the extent to which the arm 50 would otherwise have to be moved in order to engage or disengage the safety catch. As soon as the connection 57 has manually been moved above the line between the pivots 30, 58 the arm 50 is automatically turned to the desired position of the curved elastic link 56 which further facilitates operation of the safety handle 51.

The pressure required to actuate the trigger 17 when discharging the rifle is determined by the axial position of the nut 36. The extent to which the trigger is able to move is dependent on the width of the engagement between the locking shoulders 33, 39 (the overlapping) which is dependent on the angular position of the eccentric 43. The upper countersunk ends of the adjusting means 37, 44 are slotted. Upon removal of the bolt, the trigger action can thus be adjusted with regard to pressure and length of movement in accordance with the individual desire of the marksman and to suit the circumstances under which the shooting is taking place, removal of the bolt being facilitated by the easily operated locking lug 40. The plunger 46 exerts a force against setting of the screw 44 which varies in response to the angular position of the eccentric 43, and it being possible to count the number of revolutions or part revolutions through which the screw is turned, which facilitates adjustment of the screw to positions which have been found suitable by experience. The maximum radius of the eccentric 43 should be made to represent a certain safety minimum of the locking engagement between the shoulders 33, 39.

What is claimed is:

1. A rifle with a cylinder lock comprising in combination: a receiver, a rectilinearly movable and retractable breech bolt having a firing member, a firing spring and a trigger mechanism, including a trigger, a sear and a sear spring pressing on said sear toward operative holding position, a locking lug on said sear for releasably holding said firing member in a cocked position, a locking shoulder provided on said sear and a cooperating locking shoulder provided on said trigger for releasably holding said sear shoulder in the sear operative holding position by engaging and overlapping said sear locking shoulder and said trigger shoulder being withdrawable from said locking shoulder on said sear upon pulling of said trigger, said sear being depressed by said firing member into a non-holding position against the pressure of said sear spring when the rifle is discharged, said sear shoulder being disposed at the forward end of said sear, said receiver including an upwardly open rear portion having an opening therein, said locking lug of said sear passing through said opening to cooperate with said firing member, a separate assembly yoke positioned below said receiver, said sear being pivoted at its rear portion in said assembly yoke and the remainder of said trigger mechanism also being pivoted in said assembly yoke, and a movable safety mechanism pivotally supported in said assembly yoke to be movable between an on and an off position, and a ledge on said sear with which said safety mechanism cooperates to lock said sear when said safety mechanism is in its on position in either one of said operative holding or non-holding positions, according to whether the firing mechanism is in locked or released condition; and an element on said trigger to turn said sear and its locking lug out of engagement with said firing member by an extended trigger motion.

* * * * *